United States Patent [19]

Janes

[11] Patent Number: 4,765,620

[45] Date of Patent: Aug. 23, 1988

[54] RACKET VIBRATION DAMPENER COMBINED WITH GROMMET STRIP

[75] Inventor: Richard Janes, Belchertown, Mass.

[73] Assignee: Spalding & Evenflo Companies, Inc., Tampa, Fla.

[21] Appl. No.: 4,376

[22] Filed: Jan. 16, 1987

[51] Int. Cl.[4] ..... A63B 49/14

[52] U.S. Cl. ..... 273/73 G; 273/73 D

[58] Field of Search ..... 273/73, 73 C, 73 D, 273/73 E, 73 G, 73 H

[56] References Cited

U.S. PATENT DOCUMENTS

| | | |
|---|---|---|
| 1,186,283 | 6/1916 | Coddington . |
| 2,109,525 | 3/1938 | Donisthorpe . |
| 3,752,142 | 8/1973 | Morita et al. . |
| 3,804,072 | 4/1974 | Izuta . |
| 4,057,250 | 11/1977 | Kuban . |
| 4,105,205 | 8/1978 | Theodores et al. . |
| 4,135,486 | 1/1979 | Enomoto . |
| 4,180,265 | 12/1979 | Staufer . |
| 4,330,125 | 5/1982 | Sassler . |
| 4,427,195 | 1/1984 | Hufenus . |

FOREIGN PATENT DOCUMENTS

| | | | |
|---|---|---|---|
| 0171033 | 2/1986 | European Pat. Off. ..... | 273/73 R |
| 3442428 | 6/1986 | Fed. Rep. of Germany ... | 273/73 D |

*Primary Examiner*—Richard C. Pinkham
*Assistant Examiner*—William E. Stoll
*Attorney, Agent, or Firm*—Donald R. Bahr; John E. Benoit

[57] ABSTRACT

A dampening mechanism for sports implements such as tennis rackets comprising an elongated vibratable member formed of an elastomeric, energy absorbing material. The vibrational member is integral with a grommet strip which mates with the underside of the yoke of the racket and the string holes therethrough. The unit is held firmly to the frame, with the vibrational member fixed within the throat of the frame below the yoke, by the strings when the racket is strung.

6 Claims, 3 Drawing Sheets

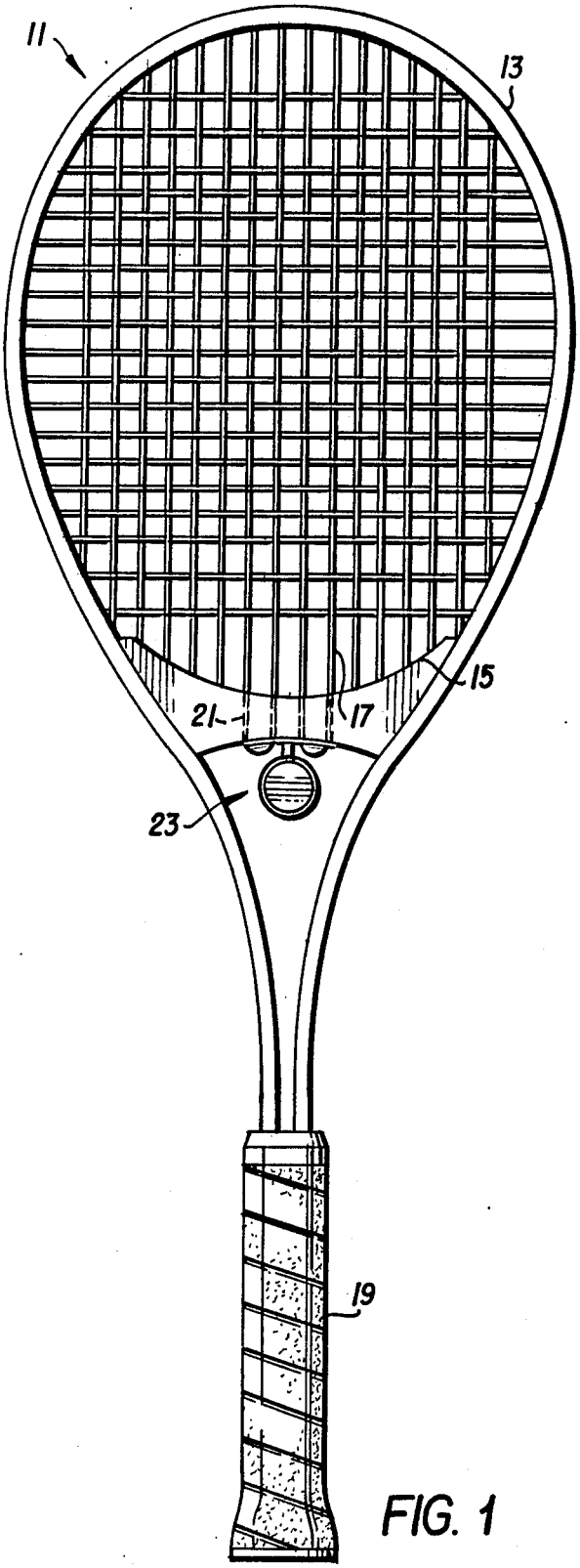
FIG. 1
FIG. 2
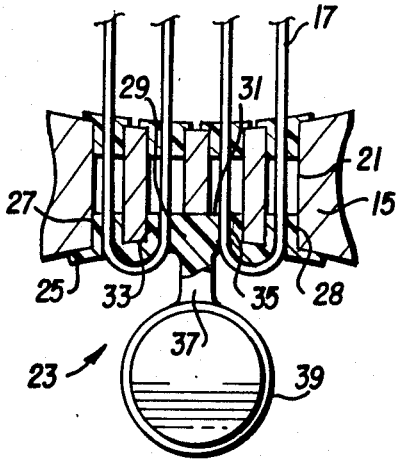
FIG. 3
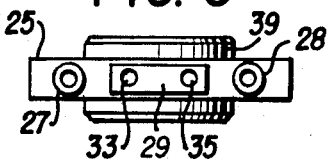
FIG. 4
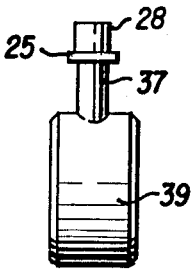

RACKET VIBRATION DAMPENER COMBINED WITH GROMMET STRIP

The present invention relates to playing rackets and, more specifically, to a device for dampening the vibration inherent in such rackets.

BACKGROUND OF THE INVENTION

In the prior art various types of rackets, including tennis rackets, have used weights which shift axially along the handle to change the balance of the racket during use. The shifting weight is used to attempt to change the center of the mass of the racket to coincide more nearly with the point of impact with the ball to obtain better results in operation. Examples of this type construction are shown in U.S. Pat. No. 879,477 issued Feb. 18, 1908, U.S. Pat. No. 1,186,283 issued June 6, 1916.

It has also been proposed to use a weight which moves transverse to the plane of the racket stringing mounted adjacent the bow or head of the racket to provide inertial rebound deadening when the racket strikes a ball. One example of this type of construction is shown in U.S. Pat. No. 4,057,250 issued Nov. 8, 1977.

This latter patent provides a vibration dampener mechanically attached to the throat area of the racket by using some extra mechanical attachment device. Accordingly, this device adds to the complexity of the racket and tends to alter the weight and balance of the racket while attempting to damp the vibration of the racket.

The vibration dampener of the present invention includes a grommet strip which attaches to the racket by utilizing the strings' tension to hold it in place. The form of the dampener grommet strip saves weight by not requiring any additional mechanical attachment device, and also assures that a constant tension will keep the dampener in firm contact with the racket. The use of such a grommet strip in combination with a vibration dampener has not, heretofore, been known in the art.

SUMMARY OF THE INVENTION

The present invention provides a dampening mechanism for sports implements such as tennis rackets comprising an elongated vibratable member formed of an elastomeric energy absorbing material. The vibration member is integral with a grommet strip, which mates with the underside of the yoke of the racket and the string holes therethrough. The unit is held firmly to the frame, with the vibrational member fixed within the throat of the frame below the yoke, by the tension of the strings when the racket is strung.

BRIEF DESCRIPTION OF THE DRAWINGS

FIG. 1 is an elevational view of a racket including the vibration dampener of the present invention;

FIG. 2 is a partial sectional view taken through the yoke of the racket of FIG. 1;

FIG. 3 is a plan view of the dampening mechanism of the present invention used in FIG. 1;

FIG. 4 is a side view of the dampening mechanism of FIG. 3;

DESCRIPTION OF THE PREFERRED EMBODIMENT

Figure 5:
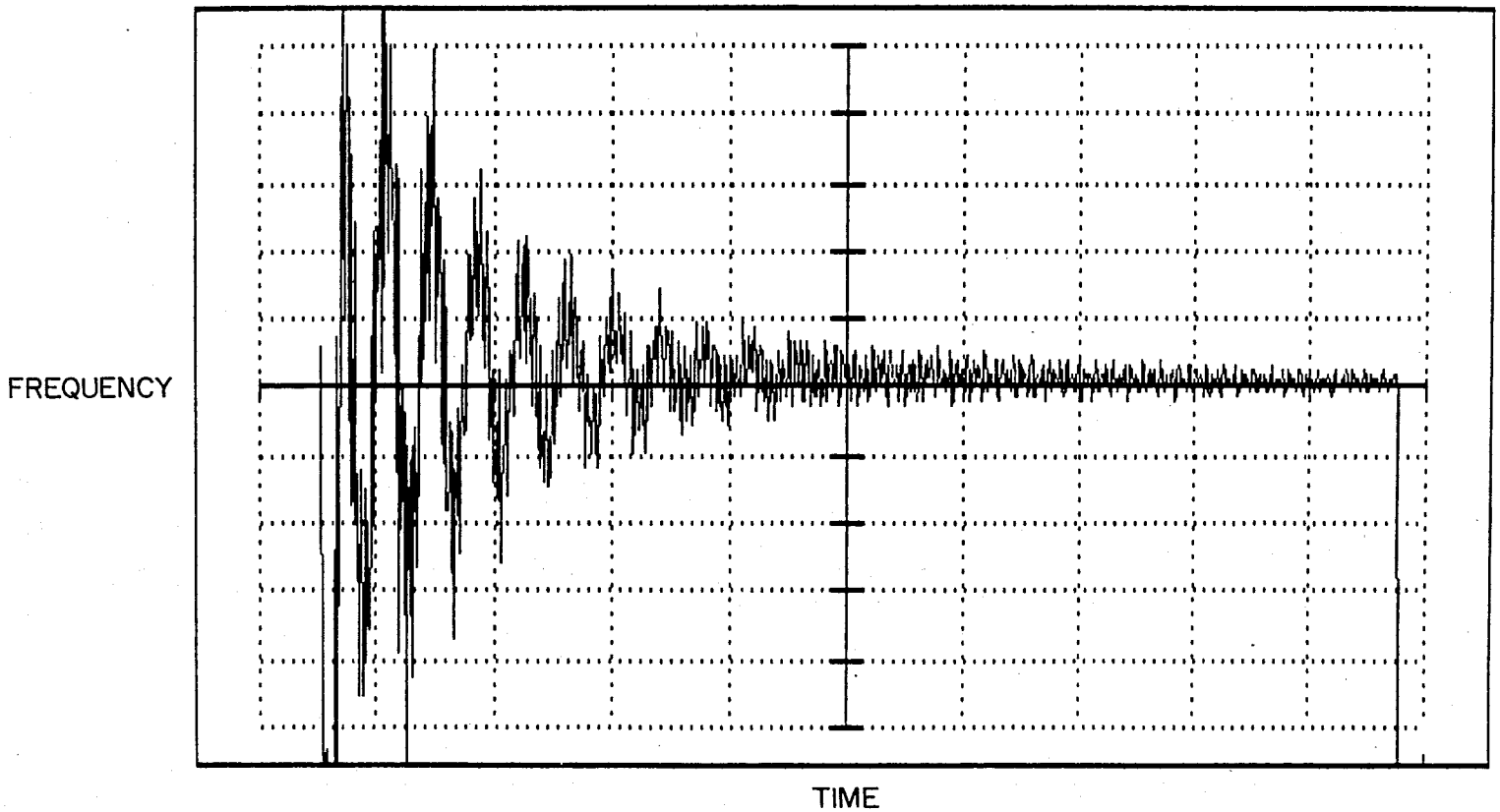
FIG. 5 is a graphic illustration of the vibration of the racket using the dampener of the present invention.

Referring now to FIG. 1, there is shown a tennis racket 11 including a frame 13 having yoke 15 extending therebetween below the bow of the frame. The frame extends downwardly with mating arms so as to form a means for securing handle 19 thereto. This is a normal racket construction which also includes the strings 17.

The string holes for the frame of the racket are not shown but are of a standard type using grommets. Four of the string holes 21 within the yoke are illustrated since they relate to the use of the dampener of the present invention.

One embodiment of the dampener of the present invention comprises dampening mechanism 23 which is more clearly shown in the drawings. A strip 25 of flexible material includes integral grommets 27 and 28. In the embodiment shown, the strip also includes an integral block 29 which mates with an indentation 31 in the yoke. This block includes string holes 33 and 35 so as to effectively provide grommets for the two associated holes through the yoke.

An arm 37 is integral with and extends downwardly from strip 25 and terminates in dampener 39. The mechanism is shown clearly in the plan view of FIG. 3 and the side view of FIG. 4 with the dampener extending below the strip 25 and connected thereto by arm 37. Block 29 is also clearly indicated and, as stated above, an indentation 31 is formed in the yoke of the racket which geometrically mates with block 29.

It should be understood that the invention is not limited to the embodiment shown in FIGS. 2–4 since geometrical configurations could be altered without departing from the scope of the invention.

As will be evident, the dampener mechanism of the present invention is simple in its configuration and easily attached to the racket while the racket is being strung. Further, this solidly secures the dampener mechanism to the racket by the tension of the strings. This constant tension keeps the dampener in firm contact with the racket.

Obviously, this invention can be adapted to fit any racket frame regardless of construction type of the material used.

The material used for the dampener is of an elastomeric, energy absorbing material with the entire mechanism being molded and of a unitary structure. Preferably, the material is a polyurethane or a nylon which has a high fatigue resistance.

Figure 6:
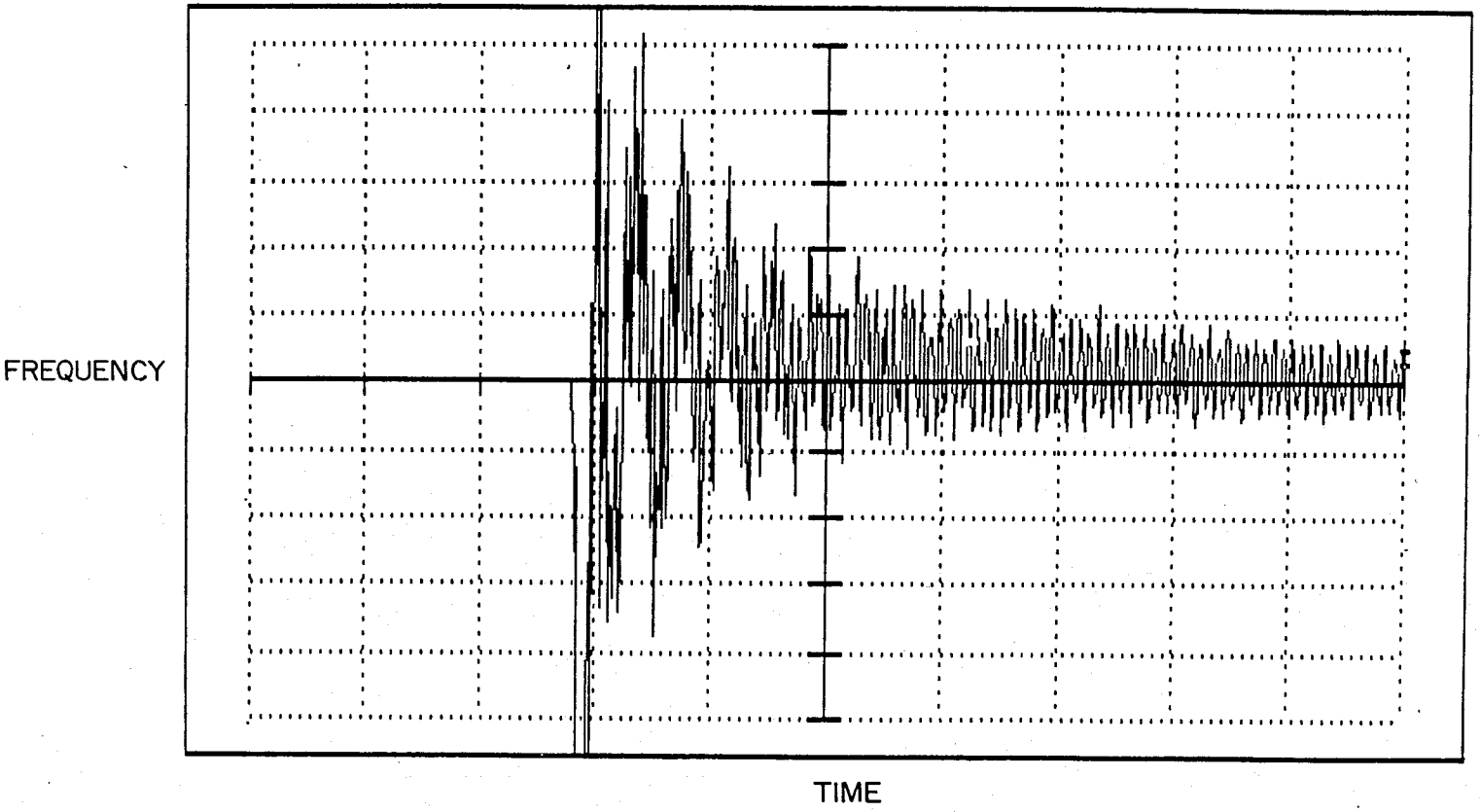
FIG. 6 is a graphic illustration of the vibration of the same tennis racket as used in FIG. 5 without the dampener.

Turning now to FIGS. 5 qand 6, there is a clear illustration of the effect of adding a dampener mechanism of the present invention to a racket. The measurements shown in the graphs were taken with the same racket with FIG. 5 having the dampener mechanism attached to the racket and FIG. 6 having the dampener mechanism removed. These graphs clearly show the advantages of using the dampener mechanism in reducing the vibration and isolating the vibration so as to provide a better feel and an improved playability.

It should be noted that the natural wavelength of the dampening device is designed to exactly match the racket frame wavelength to be damped. This provides the vibration isolation discussed above.

The above description and drawings are illustrative only since modifications could be made without departing from the present invention, the scope of which is to be limited only by the following claims.

What is claimed:

1. A dampening device for playing rackets including a frame and yoke having string holes therethrough, a handle and an open throat comprising:

a strip of flexible material;

a plurality of grommets extending above one face of said strip, said grommets having a geometrical configuration and spacing so as to mate with selected string holes in a yoke;

an arm extending from said strip on the side opposite said grommets; and a vibration dampener secured to the free end of said arm.

2. The dampening device of claim 1 wherein said strip, grommets and dampener are an integral unit formed of an elastomeric, energy absorbing material.

3. The dampening device of claim 2 wherein said energy absorbing material is polyurethane.

4. The dampening device of claim 2 wherein said energy-absorbing material is nylon.

5. The dampening device of claim 2 further comprising a block integral with said strip and having a configuration adapted to cooperate with an indentation located in the yoke of the racket; and string holes through said block.

6. The dampening device of claim 1 wherein the natural wavelength of said device matches the wavelength of the racket frame to which it is to be attached.

* * * * *